US006342111B1

(12) United States Patent
Meki et al.

(10) Patent No.: US 6,342,111 B1
(45) Date of Patent: Jan. 29, 2002

(54) ENERGY-ABSORBING MEMBER

(75) Inventors: Toshiyuki Meki; Masakazu Hirano, both of Shimonoseki (JP)

(73) Assignee: Kabushiki Kaisha Kobe Seiko Sho (Kobe Steel, Ltd.), Kobe (JP)

( * ) Notice: Subject to any disclaimer, the term of this patent is extended or adjusted under 35 U.S.C. 154(b) by 0 days.

(21) Appl. No.: 09/641,893

(22) Filed: Aug. 18, 2000

(30) Foreign Application Priority Data

Sep. 2, 1999 (JP) ..... 11-248971

(51) Int. Cl.[7] ..... C22C 21/10
(52) U.S. Cl. ..... 148/417; 420/532; 420/541
(58) Field of Search ..... 420/532, 541; 148/415, 416, 417

(56) References Cited

U.S. PATENT DOCUMENTS 3,945,861 A 3/1976 Anderson et al.
4,092,181 A 5/1978 Paton et al.
5,620,652 A * 4/1997 Tack et al. ..... 420/532

FOREIGN PATENT DOCUMENTS

JP 59-113164 * 6/1984
JP 08-170139 * 7/1996
JP 9-241785 9/1997

* cited by examiner

*Primary Examiner*—Roy King
*Assistant Examiner*—Janelle Combs-Morillo
(74) *Attorney, Agent, or Firm*—Oblon, Spivak, McClelland, Maier & Neustadt, P.C.

(57) ABSTRACT

An energy-absorbing member of extruded aluminum alloy which is composed of Mg (0.5–1.6 wt %), Zn (4.0–7.0 wt %), Ti (0.005–0.3 wt %), Cu (0.05–0.6 wt %), and at least one of the following elements: Mn (0.2–0.7 wt %), Cr (0.03–0.3 wt %), and Zr (0.05–0.25 wt %), with the remainder being Al and inevitable impurities, said energy-absorbing member having a hollow cross-section and fiber structure and being one which has undergone averaging treatment.

7 Claims, 3 Drawing Sheets

ENERGY-ABSORBING MEMBER

BACKGROUND OF THE INVENTION

1. Field of the Invention

The present invention relates to an energy-absorbing member. More particularly, the present invention relates to an energy-absorbing member for an automobile which en-counters lateral compressive loads.

2. Description of the Related Art

An energy-absorbing member is used for improved safety required in case of car crash. Its example is a bumper reinforcement to alleviate damage to the car body at the time of slight collision. An attention is directed to a bumper reinforcement of extruded aluminum alloy for weight reduction. (See Japanese Patent Laid-open Nos. 70688/1995 and 170139/1998.) The bumper reinforcement is a hollow square bar formed by extrusion. It is a so-called crush-able member which, when it receives an external energy by collision, deforms or crushes to absorb crash energy and save other members from damage.

FIG. 1 is a schematic diagram showing how deformation takes place in a bumper reinforcement 1 having a hollow rectangular cross-section (1*a* and 1*b* denoting the flanges and 1*c* and 1*d* denoting the webs). When the bumper reinforcement 1 receives a compressive force on its outer flange 1*a* at a right angle, the webs 1*c* and 1*d* deform (as indicated by an imaginary line). The energy of load is absorbed in the course of deformation.

Under regulations, a bumper reinforcement should be able to absorb a certain (minimum) amount of energy. If it is so designed as to absorb a large amount of energy, it would be excessively heavy. Therefore, the designer wants a bumper reinforcement to absorb as much energy as necessary without it becoming excessively heavy.

OBJECT AND SUMMARY OF THE INVENTION

The bumper reinforcement, which is typical of energy-absorbing members, is required to have a large capacity of energy absorption and to be light in weight. To meet this requirement, an attempt has been made to increase the strength of the extruded aluminum alloy for the bumper reinforcement. However, the 7000-series aluminum alloy (Al—Mg—Zn), which is described in the above-cited Japanese patent, is so strong that the web is liable to cracking, with its energy-absorbing capacity decreasing. In other words, the energy-absorbing capacity of extruded aluminum alloy is contradictory to the strength of extruded aluminum alloy for its weight reduction. It has been difficult to cope with this situation by metallurgical means (such as alloy composition and microstructure).

The present invention was completed in view of the foregoing. It is an object of the present invention to provide an automotive energy-absorbing member subject to lateral compressive load, which is made of high-strength Al—Mg—Zn aluminum alloy. This aluminum alloy contributes to strength as well as high energy-absorbing capacity without cracking in case of car crash.

According to the present invention, the energy-absorbing member of extruded aluminum alloy is composed of Mg (0.5–1.6 wt %), Zn (4.0–7.0 wt %), Ti (0.005–0.3 wt %), Cu (0.05–0.6 wt %), and at least one of three elements of Mn (0.2–0.7 wt %), Cr (0.03–0.3 wt %), and Zr (0.05–0.25 wt %), with the remainder being Al and inevitable impurities, and has a hollow cross-section and a fiber structure. In addition, it is finished by overaging treatment. It should preferably have a yield strength greater than 0.7 times the maximum yield strength ($\sigma$ 0.2 max) that is obtained by aging treatment.

The energy-absorbing member is superior in crushability under lateral pressure. It will find use as automotive parts, such as bumper reinforcement, frame, and door beam, which are subject to compressive load in the lateral direction.

DESCRIPTION OF THE PREFERRED EMBODIMENTS

Figure 1:
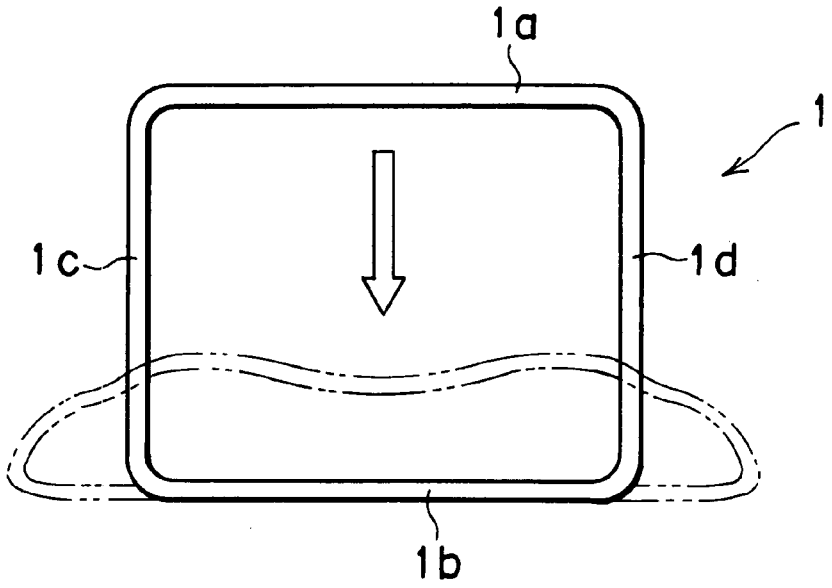
FIG. 1 is a schematic diagram showing the bumper reinforcement, before deformation (solid line) and after deformation (imaginary line).

Upon overaging treatment, the extruded Al—Mg—Zn aluminum alloy slightly decreases in yield strength but acquires the property of deforming (or collapsing) invariably without cracking under lateral compression (load perpendicular to the extrusion axis). Thus it absorbs more energy and improves in the overall collapsing characteristics.

Another result of averaging treatment is that the initial load remains low and no cracking (due to collapse) occurs at the time of collision, with the average load increasing within the effective stroke and the energy-absorbing capacity through collapse also increasing. The initial load denotes the initial maximum load within the effective stroke (35 mm in FIGS. 4 and 5 ), as explained in the load-displacement curve shown in FIGS. 4 and 5. In other words, it is the load at which buckling starts. If a large amount of energy is to be absorbed within the effective stroke, it is desirable that the maximum load occurs not in the initial stage (FIG. 4) but in the final stage within the effective stroke (FIG. 5) in the load-displacement curve.

By overaging treatment is meant in the present invention the aging treatment which is carried out at a higher temperature or for a longer time than the ordinary aging treatment which would give the maximum strength (yield strength). If the ordinary aging treatment at $T_1$° C. for $H_1$ min gives the maximum strength, then the overaging treatment should be carried out at $T_1$° C. for ($H_1$+$\alpha$) min. If the ordinary aging treatment at $T_2$° C. for $H_2$ min gives the maximum strength, then the averaging treatment should be carried out at ($T_2$+$\beta$)° C. for $H_2$ min. (where $\alpha$ and $\beta$ are positive values.) Thus, the overaging treatment depends on temperature as well as time. Insufficient overaging treatment at a low temperature will be compensated by increasing the length of treatment. In practice, the overaging treatment for the extruded aluminum alloy should be carried out at 150–180° C. for 6–12 hours.

Alternatively, the object of overaging treatment is achieved even in the case where aging treatment is suspended when the maximum strength has been obtained and then resumed by reheating. In this case, the baking step of painting during automobile assembling may be utilized for averaging treatment.

According to the present invention, the overaging treatment should be carried out such that it gives a yield strength which is more than 0.7 times the maximum yield strength ($\sigma$ 0.2 max) that is given by aging treatment. Excessive overaging treatment results in a marked decrease in strength, average load and energy absorption, and accordingly in material of no practical use. The yield strength due to overaging should preferably be smaller than 0.9 times the σ 0.2 max. Insufficient overaging treatment failing to meet this object will not improve cracking resistance and energy absorption.

In addition, overaging treatment has another advantage over ordinary aging treating in that the treated aluminum alloy improves in resistance to stress corrosion cracking, corrosion resistance, and bendability, and increases in strength, permitting the energy-absorbing member to be made thinner. Those properties are explained below.

(1) Resistance to Stress Corrosion Cracking:

Automotive bumper reinforcements and frames generally undergo bending. Those made of the Al—Mg—Zn alloy according to the present invention are subject to stress corrosion cracking which occurs at bent parts due to residual stress. Stress corrosion cracking is said to occur when precipitates at the grain boundary dissolve because they differ in potential difference from crystal grains. An alloy which has undergone ordinary aging treatment contains fine $MgZn_2$ particles continuously precipitating at the grain boundary, whereas an alloy which has undergone overaging treatment contains coarser particles discontinuously precipitating at the grain boundary. It follows, therefore, that the dissolution of particles in the latter case occurs discontinuously along the grain boundary. This is a probable reason why stress corrosion cracking hardly occurs in the latter case.

(2) Corrosion Resistance:

Overaging treatment contributes more to corrosion resistance than ordinary aging treatment for the same reason mentioned above. (Overaging treatment gives rise to coarser precipitates discontinuously separating out at the grain boundary.)

(3) Bendability:

Overaging-treated materials permits greater local elongation than aging-treated materials when they are bent with a small bending radius (as indicated by the stress-strain curve in FIG. 6). Therefore, the former are less subject to work cracking than the latter and hence suitable for bumper reinforcements and frames which need bending under severe conditions.

(4) Smaller Wall Thickness:

In general, the energy-absorbing member is more subject to crush cracking at the time of collision as it decreases in wall thickness. Even though the energy-absorbing member has a strength high enough to justify the reduction of its wall thickness, a reduced wall thickness is impracticable from the standpoint of preventing cracking. This is not the case, however, if the energy-absorbing member is made of the overaging-treated material which is less subject to crush cracking than the aging-treated material.

In what follows, we will explain the reason why the extruded aluminum alloy of the present invention is incorporated with various components in specific amounts.

Zn

Zn coexisting with Mg imparts the aging property to the alloy. It increases strength through aging. With a Zn content lower than 4.0%, the alloy has insufficient strength and poor energy absorption. With a Zn content higher than 7.0%, the alloy is poor in extrudability, workability with a low elongation and bending resistance to stress corrosion cracking and corrosion resistance. Therefore, the Zn content should be 4.0–7.0%, preferably 6.0–7.0%.

Mg

Mg is an important element to enhance the strength of the aluminum alloy. An Mg content less than 0.5% is poor in energy absorption and is not enough to enhance strength. An Mg content in excess of 1.6% has an adverse effect on extrudability, elongation, resistance to stress corrosion cracking and corrosion resistance. Therefore, the Mg content should be 0.5–1.6%, preferably 0.6–1.0%.

Ti

Ti renders crystal grains finer in the aluminum alloy ingot. A Ti content less than 0.005% is not enough to produce this effect. A Ti content in excess of 0.3% does not heighten this effect any longer but leads to large particles. Therefore, the Ti content should be 0.005–0.3%.

Cu

Cu enhances the strength of the aluminum alloy. Cu is added to attain the desired high strength. In addition, Cu improves resistance to stress corrosion cracking. A Cu content less than 0.05% is not enough to produce this effect. It is poor in energy absorption. A Cu content in excess of 0.6% produces an adverse effect on extrudability and increases the quenching sensitivity, thereby reducing strength, bendability and workability corrosion resistance. Therefore, the Cu content should be 0.05–0.6%, preferably 0.1–0.2%.

Mn, Cr, and Zr

These elements form the fiber structure in the extruded aluminum alloy, thereby strengthening the alloy. One or more of them are added. Their respective contents of 0.2%, 0.03%, and 0.05% are not enough to produce the desired effect. Their respective contents in excess of 0.7%, 0.3%, and 0.25% produce an adverse effect on extrudability and increases the quenching sensitivity, thereby reducing strength. Therefore, the Mn content should be 0.2–0.7%, the Cr content should be 0.03–0.3%, and the Zr content should be 0.05–0.25%, preferably 0.1–0.2%. When more than one element are added, the total content should be larger than 0.1%, preferably less than 0.4% so as to prevent the quenching sensitivity from decreasing in the case of air-cooled press quenching.

Inevitable Impurities

Inevitable impurities in aluminum metal are dominated by Fe. Fe in excess of 0.35% causes intermetallic compounds to crystallize out in the form of coarse particles at the time of casting, thereby impairing the mechanical properties of the aluminum alloy. Consequently, the Fe content should be lower than 0.35%. The aluminum alloy in the stage of casting is readily contaminated with impurities originating from raw metal and intermediate alloys containing elements to be added. Except for Fe, these contaminating elements have very little effect on the characteristic properties of the aluminum alloy so long the amount of individual impurities is less than 0.05% and their total amount is less than 0.15%. Consequently, the amount of individual impurities should be less than 0.05% and their total amount should be less than 0.15%. The amount of B should be less than 0.02%, preferably less than 0.01%. B is accompanied by Ti added to the aluminum alloy, with the ratio of B/Ti being ⅕.

According to the present invention, the extruded aluminum alloy for the energy-absorbing member should have the fiber crystal structure which is elongated in the direction of extrusion (hot working). The fiber structure contributes to strength and resistance to lateral crush cracking after overaging treatment than the equiaxial recrystallization texture. The extruded aluminum alloy have any cross section, e.g., rectangular cross section consisting of front and rear flanges (perpendicular to the direction of load) and a pair of webs (parallel to the direction of load) connected to the flanges.

EXAMPLES

Figure 2:
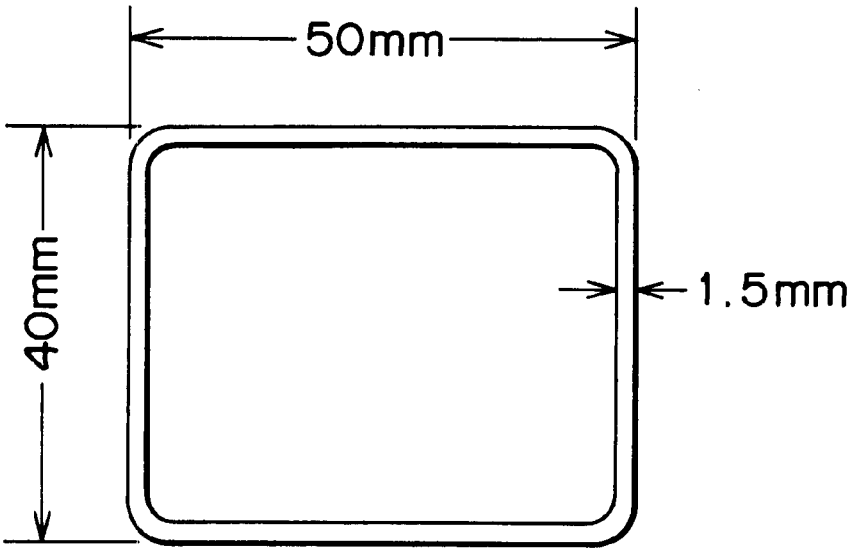
FIG. 2 is a diagram showing the cross section of the energy-absorbing member used in the example.
Figure 3:
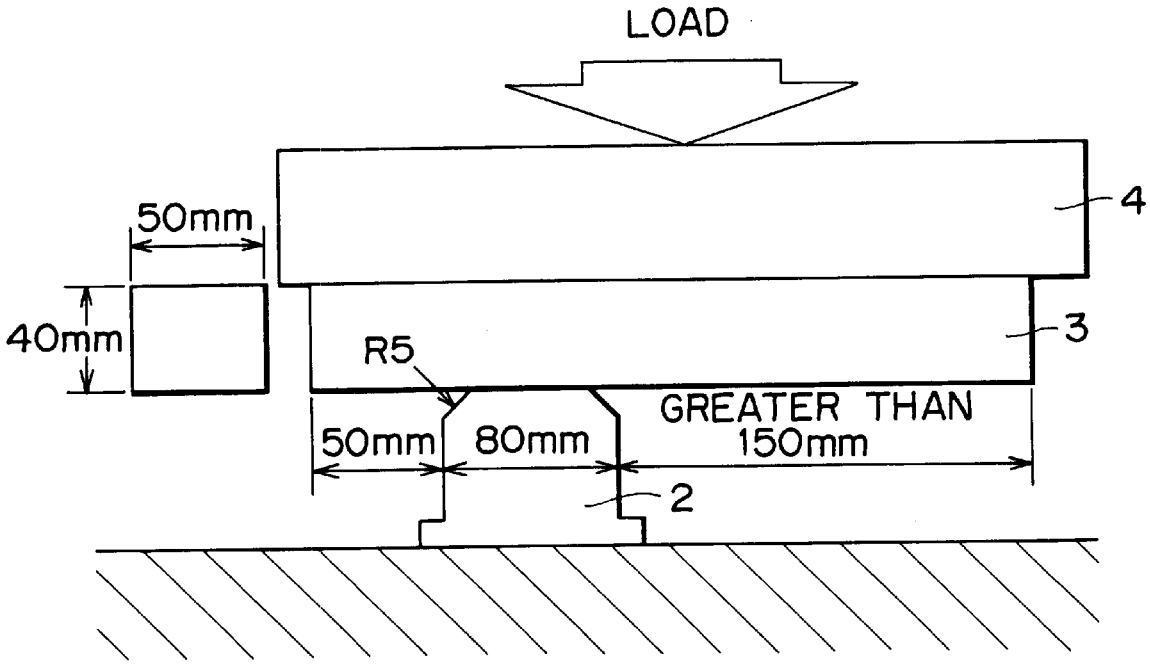
FIG. 3 is a diagram showing the method of testing lateral crushing in the example.

In each example, an Al—Mg—Zn alloy having the chemical composition shown in Table 1 was melted in the usual way and the resulting melt was cast into an ingot (200 mm in diameter) by semi-continuous casting. After homogenizing heat treatment, the ingot was extruded at a rate of 7 m/min into a hollow object having a square cross section as shown in FIG. 2. Extrusion (at 460° C.) was followed by air-cooled press quenching. As to No. 15, water-cooled press quenching was applied because air-cooled press quenching did not effect sufficiently. In table 2, the data of No. 15 are by water-cooled press quenching and the data in parenthesis are by air-cooled press quenching. The extrudate was cut in short lengths, and cut pieces underwent heat treatment under the conditions shown in Table 1. Thus there were obtained samples. Incidentally, T5 and T7 in Table 1 imply aging treatment and averaging treatment, respectively.

TABLE 1

| | Chemical composition of samples (mass %) | | | | | | | | | | |
|---|---|---|---|---|---|---|---|---|---|---|---|
| No. | Si | Fe | Cu | Mn | Mg | Cr | Zn | Ti | Zr | Aging treatment | Remarks |
| 1 | 0.05 | 0.20 | 0.14 | 0.01 | 0.79 | 0.02 | 6.36 | 0.02 | 0.15 | 70° C. × 5 hr → 130° C. × 12 hr* | T5 |
| 2 | | | | | | | | | | 70° C. × 5 hr → 165° C. × 6 hr | T7 |
| 3 | | | | | | | | | | 70° C. × 5 hr → 175° C. × 6 hr | T7 |
| 4 | | | | | | | | | | 70° C. × 5 hr → 175° C. × 12 hr | T7 |
| 5 | | | | | | | | | | 70° C. × 5 hr → 175° C. × 24 hr* | T7 |
| 6 | 0.03 | 0.19 | 0.14 | 0.02 | 1.47 | 0.04 | 6.52 | 0.02 | 0.12 | 70° C. × 5 hr → 130° C. × 12 hr* | T5 |
| 7 | | | | | | | | | | 70° C. × 5 hr → 175° C. × 6 hr | T7 |
| 8 | 0.05 | 0.21 | 0.17 | 0.38 | 1.10 | 0.22 | 4.62 | 0.05 | 0.14 | 70° C. × 5 hr → 130° C. × 12 hr* | T5 |
| 9 | | | | | | | | | | 70° C. × 5 hr → 175° C. × 6 hr | T7 |
| 10 | 0.05 | 0.21 | 0.14 | Tr.* | 0.80 | Tr.* | 6.38 | 0.02 | Tr.* | 70° C. × 5 hr → 175° C. × 6 hr | T7 |
| 11 | 0.07 | 0.18 | 0.13 | 0.01 | 1.68* | 0.02 | 6.35 | 0.03 | 0.14 | 70° C. × 5 hr → 175° C. × 6 hr | T7 |
| 12 | 0.05 | 0.20 | 0.14 | 0.03 | 0.43* | 0.02 | 6.37 | 0.02 | 0.15 | 70° C. × 5 hr → 175° C. × 6 hr | T7 |
| 13 | 0.04 | 0.19 | 0.14 | 0.02 | 0.82 | 0.03 | 7.90* | 0.02 | 0.14 | 70° C. × 5 hr → 175° C. × 6 hr | T7 |
| 14 | 0.05 | 0.20 | 0.13 | 0.01 | 0.80 | 0.02 | 3.21 | 0.03 | 0.14 | 70° C. × 5 hr → 175° C. × 6 hr | T7 |
| 15 | 0.06 | 0.21 | 0.65* | 0.01 | 0.77 | 0.03 | 6.35 | 0.02 | 0.16 | 70° C. × 5 hr → 175° C. × 6 hr | T7 |
| 16 | 0.04 | 0.21 | Tr.* | 0.03 | 0.79 | 0.02 | 6.37 | 0.03 | 0.16 | 70° C. × 5 hr → 175° C. × 6 hr | T7 |

*Outside the scope of the invention.

Figure 4:
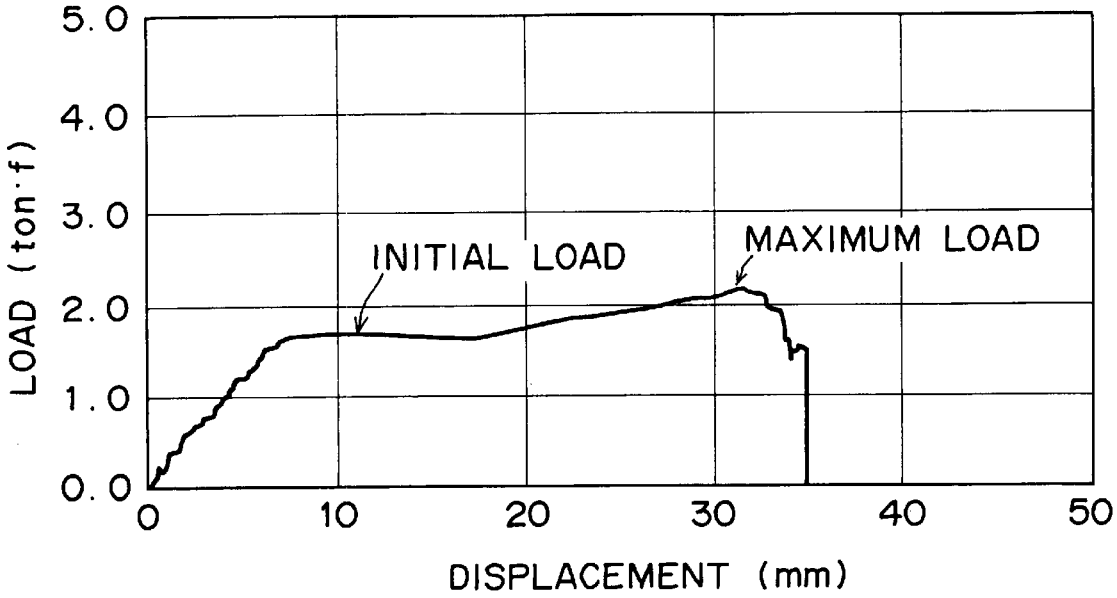
FIG. 4 is a diagram showing the load-displacement curve (No. 1) obtained in the lateral crushing test in the example.
Figure 5:
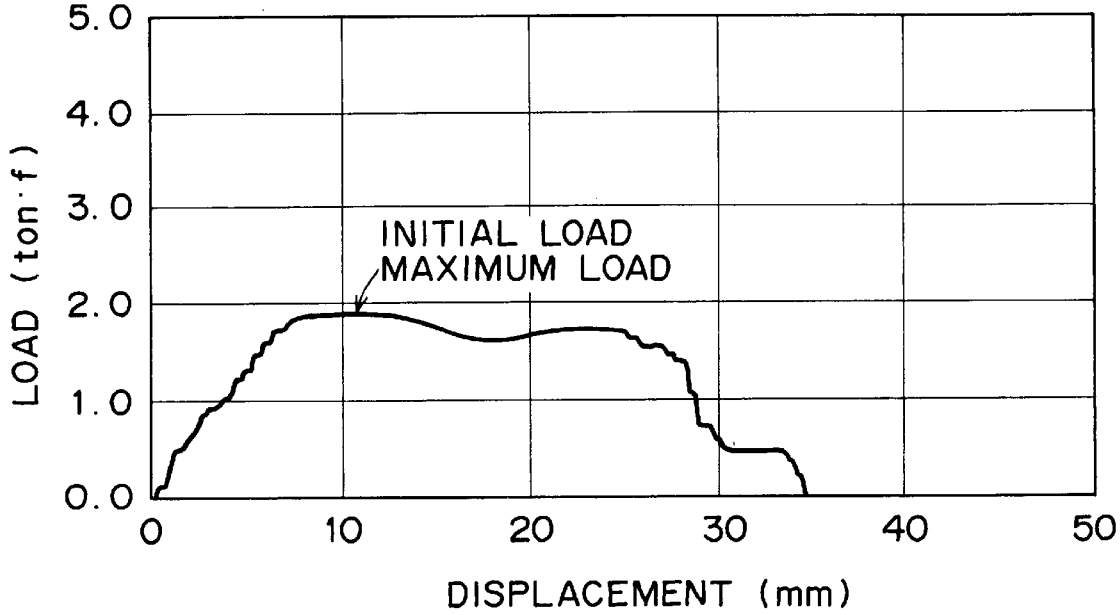
FIG. 5 is a diagram showing the load-displacement curve (No. 2) obtained in the lateral crushing test in the example.

Each sample had its web (40 mm wide) cut into specimens conforming to JIS No. 13(B). The specimens were examined for mechanical properties by tensile test. Each sample was also examined for lateral crushing in the following way by using a 30-ton universal tester. A sample 3 is fixed to a stay 2 with a double-coated pressure sensitive tape. The stay 2 has a sample fixing face measuring 80 mm long and 50 mm wide. A rigid body 4 is pressed under a lateral load against the upper surface of the sample 3 until the sample is crushed. The amount of displacement (or effective stroke) is 35 mm. Table 2 shows the results of the tests (in terms of an average of two measurements). FIGS. 4 and 5 show the displacement-load curve of sample Nos. 1 and 2. Incidentally, the crush crack rank in Table 2 indicates the web's tendency toward cracking which is rated as 1 (no cracks), 2 (cracks not penetrating thick walls), 3 (cracks partly penetrating thick walls), 4 (broken into pieces by cracks penetrating thick walls), and 5 (broken into pieces by cracks).

The extrudability in Table 2 indicates the critical extrusion speed for samples Nos. 6 to 16 which gives the same surface quality as obtained when samples Nos. 1 to 5 are extruded at 7 m/min. The critical extrusion speed is rated as ○ (greater than 90%), as Δ (from 70% to 89%), and as X (smaller than 69%).

TABLE 2

| | Mechanical and crushing properties of samples | | | | | | | | | | | | |
|---|---|---|---|---|---|---|---|---|---|---|---|---|---|
| | Mechanical properties | | | | Crushing properties | | | | | Resistance | | | |
| No. | σ B N/mm² | σ 0.2 N/mm² | Elongation (%) | Structure* | Absorbed energy (J) | Initial load (kN) | Max. load (kN) | Ave. load (kN) | Crush crack rank | to stress corrosion cracking | Bendability | Corrosion resistance | Extrudability |
| 1 | 419 | 358 | 13.8 | F | 453 | 18.5 | ← | 12.9 | 4 | Δ | Δ | Δ | ○ |
| 2 | 366 | 330 | 12.8 | F | 551 | 17.2 | 21.6 | 15.7 | 2 | ○ | ○ | ○ | ○ |
| 3 | 337 | 303 | 12.5 | F | 542 | 16.4 | 21.1 | 15.4 | 1 | ○ | ○ | ○ | ○ |
| 4 | 322 | 282 | 12.6 | F | 525 | 15.2 | 19.3 | 15.0 | 1 | ○ | ○ | ○ | ○ |
| 5 | 308 | 247 | 12.2 | F | 485 | 14.2 | 17.3 | 13.9 | 1 | ○ | ○ | ○ | ○ |
| 6 | 512 | 469 | 15.4 | F | 495 | 22.6 | ← | 14.1 | 4 | Δ | Δ | Δ | ○ |
| 7 | 443 | 380 | 14.2 | F | 571 | 20.6 | 22.5 | 16.3 | 1 | ○ | ○ | ○ | ○ |
| 8 | 409 | 345 | 14.4 | F | 419 | 17.1 | ← | 12.0 | 4 | ○ | Δ | ○ | ○ |
| 9 | 362 | 291 | 13.2 | F | 530 | 15.8 | 21.3 | 15.1 | 1 | ○ | ○ | ○ | ○ |
| 10 | 320 | 279 | 8.3 | R | 460 | 15.0 | ← | 13.1 | 5 | x | x | ○ | ○ |
| 11 | 465 | 403 | 11.2 | F | 289 | 21.8 | 26.5 | 16.8 | 2 | x | x | ○ | x |
| 12 | 292 | 242 | 15.4 | F | 478 | 13.1 | 16.6 | 13.6 | 1 | ○ | ○ | ○ | ○ |
| 13 | 459 | 396 | 12.8 | F | 577 | 21.4 | 26.2 | 16.5 | 2 | x | Δ | x | Δ |
| 14 | 295 | 238 | 14.5 | F | 474 | 12.9 | 16.7 | 13.5 | 1 | ○ | ○ | ○ | ○ |
| 15 | 364 | 330 | 12.5 | F | 553 | 17.6 | 22.1 | 15.8 | 2 | ○ | x | x | x |

TABLE 2-continued

Mechanical and crushing properties of samples

| No. | Mechanical properties σ B N/mm² | σ 0.2 N/mm² | Elongation (%) | Structure* | Crushing properties Absorbed energy (J) | Initial load (kN) | Max. load (kN) | Ave. load (kN) | Crush crack rank | Resistance to stress corrosion cracking | Bendability | Corrosion resistance | Extrudability |
|---|---|---|---|---|---|---|---|---|---|---|---|---|---|
| | (262) | (224) | (15.4) | | (462) | (12.0) | (13.2) | (13.2) | (1) | | | | |
| 16 | 317 | 265 | 14.2 | F | 495 | 14.2 | 18.9 | 14.1 | 2 | x | ○ | ○ | ○ |

* F: Fiber structure;
R: Equiaxial structure.

In another example, an Al—Mg—Zn alloy having the chemical composition shown in Table 1 was made into an ingot. This ingot underwent extrusion and ensuing press quenching under the same condition as that for extrusion mentioned above. There was obtained an extruded flat bar with a cross section measuring 150 mm wide and 2 mm thick. After heat treatment, the flat bar was examined for resistance to stress corrosion cracking, bendability, and corrosion resistance in the following manner.

Resistance to Stress Corrosion Cracking:

A specimen was taken from each sample such that stress is applied in the LT direction (perpendicular to the direction of extrusion). The specimen was immersed in a testing solution (containing 36 g of chromic anhydride, 30 g of potassium dichromate, and sodium chloride 3 g dissolved in 1 liter of pure water) at 95° C. for 360 minutes under a load (as in three-point bending test) equivalent to 100% and 75% of the yield strength of the sample. The specimen was examined using a magnifier (×25) and rated according to the presence or absence of cracks on its surface as follows.

○: no cracking.

Δ: cracking only in the case of 100% load.

X: cracking in the case of 75% load.

Bendability:

A 2-mm thick specimen taken from each sample was bent (180°) around a jig having a radius of curvature of 2 mm (as in three-point bending test). The bent specimen was visually examined for cracking and rated according to the presence or absence of cracks on its surface as follows.

○: no cracks.

Δ: fine cracks.

X: penetrating cracks.

Corrosion Resistance:

A specimen taken from the sample was tested according to JIS Z2371 (salt water spray). After spraying for 2000 hours, the corrosion weight loss was measured. The specimen was rated according to the corrosion weight loss as follows.

○: less than 15% compared with the reference.

Δ: less than 30% compared with the reference.

X: more than 31% compared with the reference.

No. 3 is the reference for Nos. 1, 2, 4, 5, and 10 to 14.
No. 7 is the reference for No. 6.
No. 9 is the reference for No. 8.

The following is noted from Table 2. Samples Nos. 2 to 5, which had undergone averaging treatment, were lower in yield strength than sample No. 1 (having the highest strength) but were better in crush crack rank and energy absorption. Sample No. 1 is characterized in that the initial load equals the maximum load and greatly differs from the average load, whereas samples Nos. 2 to 5 are characterized in that the initial load is small and close to the average load. Samples Nos. 3 and 4 are good in crush crack rank and energy absorption, but sample No. 5 is too poor to be practical in yield strength and energy absorption due to overaging treatment. Samples Nos. 2 to 4 are low in yield strength but high in energy absorption on account of improvement in crush cracking. This is indicated in FIG. 5 by the fact that the load decreased little or did not decrease at all in the last half of displacement (25–35 mm).

Samples Nos. 7 and 9, which had undergone overaging treatment, were superior to samples Nos. 6 and 8, respectively, in crush crack rank and energy absorption and other properties. Sample No. 10, was inferior in crush crack rank and energy absorption despite overaging treatment because it contains neither Mn, Cr, nor Zr and hence has the equiaxial crystalline structure. It is inferior also in resistance to stress corrosion cracking and bendability. Samples Nos. 11 to 16, which are out of the scope of the present invention, are good in crush crack rank but are poor in either energy absorption or other properties.

Effect of the Invention

The present invention affords an automotive energy-absorbing member made of extruded aluminum alloy which has high strength and exceeds in lateral crushing properties under compressive load in case of collision in the lateral direction.

What is claimed is:

1. An energy-absorbing member of extruded aluminum alloy consisting of:

Mg: 0.5–1.6 wt %;

Zn: 4.0–7.0 wt %;

Ti: 0.005–0.3 wt %;

Cu: 0.05–0.6 wt %;

at least one of Mn: 0.2–0.7 wt %, Cr: 0.03–0.3 wt %, and Zr: 0.05–0.25 wt %; and the remainder being Al and inevitable impurities, wherein the energy-absorbing member has fiber structure and has undergone overaging treatment;

the energy-absorbing member has a yield strength greater than 0.7 times the maximum yield strength (σ 0.2 max) that is obtained by aging treatment; and the energy-absorbing member has a yield strength smaller than 0.92 times the maximum yield strength (σ 0.2 max) that is obtained by aging treatment.

2. The energy-absorbing member of extruded aluminum alloy as defined in claim 1, wherein the overaging treatment has been carried out in such a way that aging treatment is suspended when the maximum strength has been obtained and then resumed by reheating.

3. The energy-absorbing member of extruded aluminum alloy as defined in claim 1, wherein the overaging treatment has been carried out at 150–180° C. for 6–12 hours.

4. The energy-absorbing member of extruded aluminum alloy as defined in claim 1, wherein said energy-absorbing member has a hollow cross-section.

5. The energy-absorbing member of extruded aluminum alloy as defined in claim 1, wherein the energy-absorbing member has a crushing property such that the absorbing energy is greater than 460 J, the maximum load is smaller than 17.2 kN, and the average load is greater than 14.1 kN.

6. The energy-absorbing member of extruded aluminum alloy as defined in claim 5, wherein said energy-absorbing member has a hollow cross-section.

7. A method of making an energy-absorbing member, the method comprising averaging an extruded aluminum alloy; and producing the energy-absorbing member of extruded aluminum alloy of claim 1.

* * * * *